US006457893B1

(12) United States Patent
Hamilton

(10) Patent No.: US 6,457,893 B1
(45) Date of Patent: Oct. 1, 2002

(54) PERSONAL HYGIENE DEVICE FOR MOISTENING TISSUE

(76) Inventor: George Wesley Hamilton, 9420 Shoreview Rd., Dallas, TX (US) 75238

( * ) Notice: Subject to any disclaimer, the term of this patent is extended or adjusted under 35 U.S.C. 154(b) by 0 days.

(21) Appl. No.: 09/929,795

(22) Filed: Aug. 13, 2001

(51) Int. Cl.[7] ..... B43K 8/12; B43M 11/06

(52) U.S. Cl. ..... 401/207; 401/148; 401/196; 401/206; 401/127; 401/130; 222/192

(58) Field of Search ..... 401/5, 126, 127, 401/130, 148, 196, 198, 199, 202, 205, 206, 207; 118/264; 222/108, 111, 163, 181.1, 1, 182, 192

(56) References Cited

U.S. PATENT DOCUMENTS

| | | | | | |
|---|---|---|---|---|---|
| 1,279,961 | A | | 9/1918 | Anable | |
| 2,402,707 | A | | 6/1946 | Stepan | |
| 2,820,234 | A | | 1/1958 | Rigney | |
| 3,133,308 | A | * | 5/1964 | Claypool | 401/207 |
| 3,796,185 | A | | 3/1974 | Boone | |
| 3,910,299 | A | | 10/1975 | Spencer | |
| 4,235,333 | A | | 11/1980 | Boone | |
| 4,798,312 | A | | 1/1989 | Scheiber | |
| 4,901,889 | A | | 2/1990 | Mitchell | |
| 4,961,661 | A | | 10/1990 | Sutton | |
| 5,299,877 | A | | 4/1994 | Birden | |
| 5,435,465 | A | * | 7/1995 | El-Amin | 222/108 |
| 5,597,255 | A | | 1/1997 | Yager | |
| 5,672,206 | A | | 9/1997 | Gorman | |
| 5,887,759 | A | * | 3/1999 | Ayigbe | 222/192 |
| 5,931,591 | A | | 8/1999 | McCracken | |

FOREIGN PATENT DOCUMENTS

| | | | | |
|---|---|---|---|---|
| CH | CH 641359 A5 | * | 2/1984 | 401/207 |

* cited by examiner

*Primary Examiner*—Gregory Huson
*Assistant Examiner*—Tuan Nguyen

(57) ABSTRACT

A personal hygiene device for moistening tissue (in particular toilet tissue) utilizes a fluid container having a fluid dispensing attachment to apply fluid onto tissue. The hygiene device is held in an inverted position by a bracket, with the bracket typically mounted on a wall or fixture adjacent to a tissue holder. The hygiene device consists of a fluid container, a cap, a sponge pad, and a dispensing cover. The fluid container acts as a refillable reservoir for the fluid and the cap has holes in the end to allow fluid discharge to the sponge pad from the fluid container. The dispensing cover encloses the cap and sponge, securing them to the fluid container. The dispensing cover has multiple orifices in the end and when activated by depressing with tissue, the dispensing cover slides on the cap thereby compressing the sponge pad. The sponge pad, being saturated with fluid from the fluid container, when depressed, causes fluid to be pumped through multiple orifices in the end of the dispensing cover onto the tissue. The traverse of the dispensing cover, relative to the cap, limits the compression of the sponge pad and the amount of fluid that is expelled with the orifice pattern of the dispensing cover determining the area of tissue to be moistened.

10 Claims, 2 Drawing Sheets

FIG. 1

PERSONAL HYGIENE DEVICE FOR MOISTENING TISSUE

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

The present invention relates to a personal hygiene device. Prior art describes a number of methods to apply fluid to toilet tissue utilizing a variety of dispensing apparatus. Several of these devices moisten toilet tissue by dispensing a fluid from a device attached as an accessory to conventional toilet tissue holders, such as, U.S. Pat. No. 3,910,229 to Spencer and U.S. Pat. No. 567,206 to Gorman. These devices utilize the core of the tissue roll by placing a fluid container into the core and moisten the tissue via a spray arm extending over the tissue roll. These devices appear to be cumbersome to install and operate and do not provide an adequate means of controlling the amount of fluid dispersed onto the tissue.

Additional tissue moistening devices are mounted independently or are attachable to the tissue holder and moisten the tissue utilizing a spray pump mechanism as illustrated by U.S. Pat. No. 5,887,759 to Ayigbe and U.S. Pat. No. 5,435,465 to El-Armin. These systems rely on a spray pump attached to the container of fluid and in general should provide some degree of controlling the dispensing of fluid as well as the area of tissue covered. The disadvantage of these devices is that refilling the container with fluid is somewhat of a problem and that the devices are complex and costly to manufacture.

Fluid dispensing devices, not specifically intended for use as a device to moisturize tissue, but being somewhat adaptable for that purpose are described in U.S. Pat. No. 5,597,255 to Yager and U.S. Pat. No. 5,299,877 to Birden. These devices essentially provide a hand held container having a cap formed to include a sponge type applicator for the application of fluid. Considerable modification of these devices would be necessary for them to be used as a device for moistening tissue as the devices are not suited to being wall mounted in an inverted position and do not dispense a metered amount of fluid uniformly to an area of the tissue.

A need exists for an easily used personal hygiene device, one that can be operated by the user with a single hand, and supplies a metered amount of fluid in a uniform pattern to a selected area of tissue. Additionally the device should be easily refillable and of moderate cost. It is the object of this invention to provide such a device.

BRIEF SUMMARY OF THE INVENTION

It is the object of this invention to provide an inexpensive self-contained hygiene device for the moistening of all types of toilet tissue. The hygiene device can be conveniently mounted near a tissue dispenser and is operated using only one hand. The hygiene device is easily refillable and provides a measured dispensing of fluid over a specific area of tissue. The hygiene device consists of a bracket, holding an inverted fluid container, with the container having an attached dispenser for the fluid.

The user moistens tissue with the hygiene device by placing a tissue beneath the dispenser and using an upward motion, depresses the end of the dispenser with the tissue. Fluid is forced onto the tissue from the fluid container through the dispenser, the dispenser acting as a pumping device. Fragrances and antiseptics may be used in the fluid and decoration may be added to the container of the hygiene device with little cost. Assembly and manufacture of the hygiene device is inexpensive and relatively simple as few parts are employed.

DETAILED DESCRIPTION OF THE INVENTION

Figure 1:
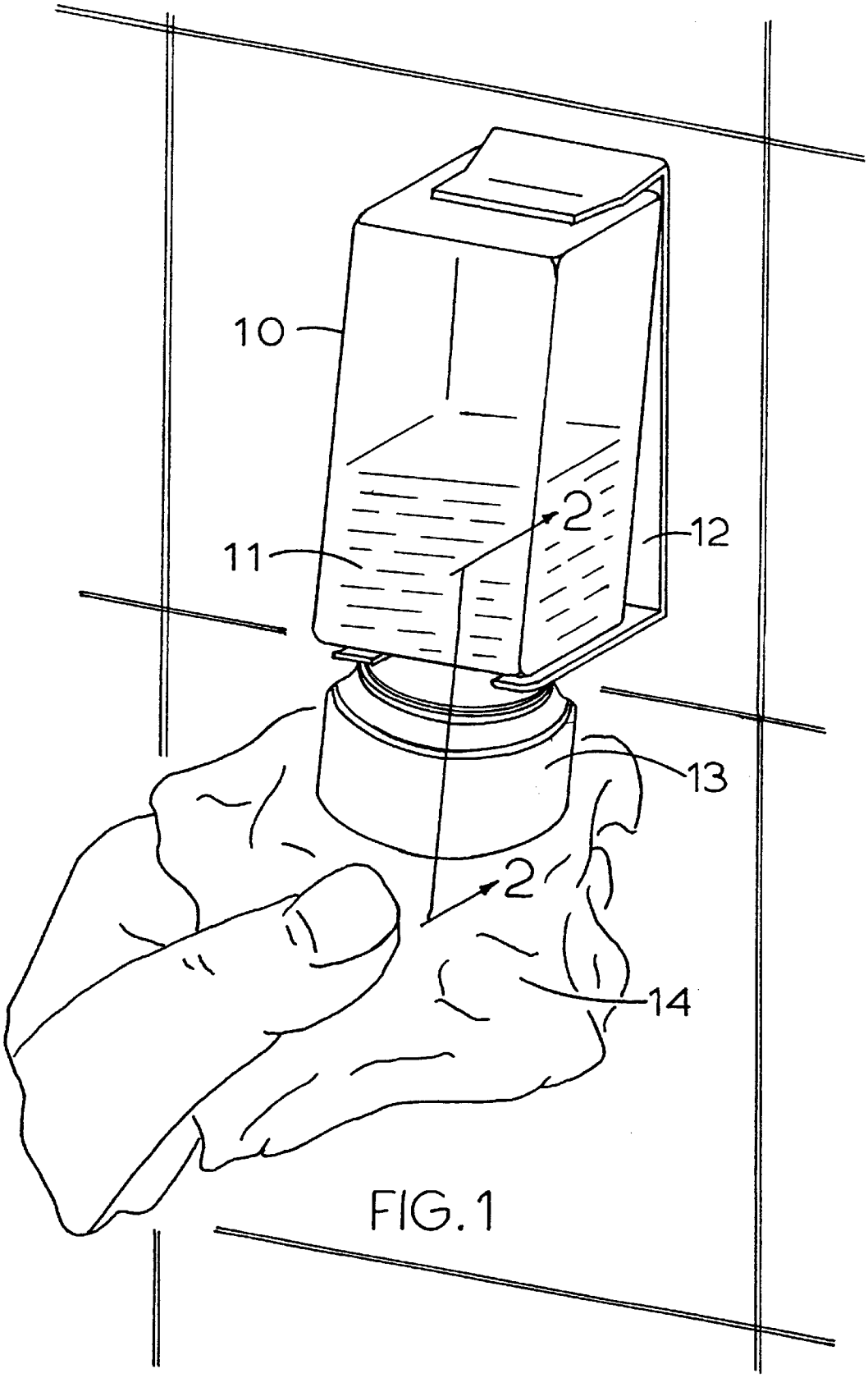
FIG. 1. A perspective view of the hygiene device and bracket with tissue applied.

Referring to FIG. 1, The hygiene device for the moistening of tissue includes an inverted fluid container 10, a fluid 11, a bracket 12, and a fluid dispensing attachment 13. The fluid container 10 may be a commercially available glass or plastic container provided with a screw-on lid, or similar means of engagement for the fluid dispensing attachment 13. The fluid container 10, containing fluid 11, with the dispensing attachment 13 are inverted, being held away form the wall at a slight angle to provide easy access utilizing a bracket 12. It is understood that the bracket 12 may be made in several configurations utilizing plastic or metal to hold the hygiene device. The bracket 12 itself may be mounted utilizing pressure sensitive tape or commercially available fasteners. FIG. 1 depicts tissue 14 being moistened by an operator utilizing the hygiene device.

Figure 2:
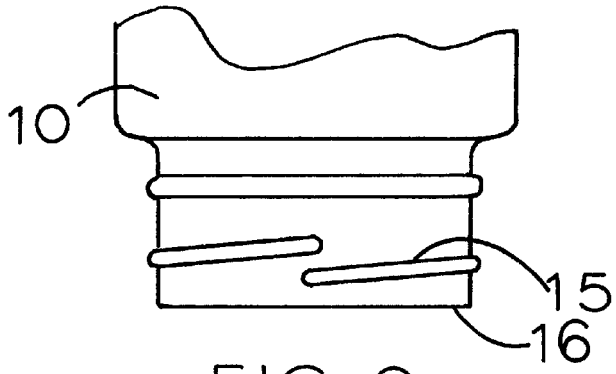
FIG. 2. An exploded view from FIG. 1, section 2—2 showing the open end of the fluid container.
Figure 3:
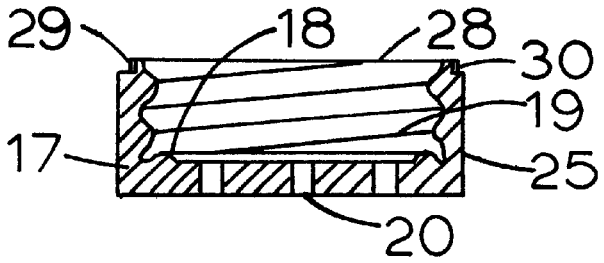
FIG. 3. An exploded view from FIG. 1, section 2—2 showing a cross section of the cap.
Figure 4:
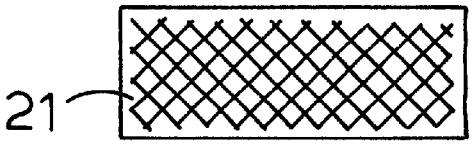
FIG. 4. An exploded view from FIG. 1, section 2—2 showing a cross section of the sponge pad.

With reference to FIG. 1, section 2—2, FIGS. 2, 3, 4, and 5, comprise an exploded view detailing the assembly and parts of the fluid dispensing attachment 13. FIG. 2 shows a portion of the fluid container 10 having a threaded portion 15 and opening 16, which attaches to a cap 17 (FIG. 3). The cap 17 provides a sealing surface 18 for the fluid container opening 16 and a mating female thread 19 to the fluid container male thread 15. The cap 17 has multiple holes 20 in the end, the holes being of sufficient size to allow free flow of fluid form the fluid container 10 to a sponge pad 21 (FIG. 4). The sponge pad 21 is of commercially available porous foam material, and has the moisture retention and resiliency common to sponges in general. The sponge pad 21 is formed to fit into the dispensing cover 22 (FIG. 5), and is assembled with the sponge pad 21 contacting the inside face 23 of the dispensing cover 22.

The cap 17 (FIG. 3) is fitted in assembly into the dispensing cover 22 (FIG. 5) with clearance between the outside wall 25 of the cap 17 and the inside wall 24 of the dispensing cover 22 to provide unencumbered movement between the two When the cap 17 is assembled into the dispensing cover 22, which contains the sponge pad 21, pawls 26 and 27 are urged apart, permitting the entry of the cap 17. A compression of the thickness of the sponge pad 21 occurs as the cap 17 is inserted into the dispensing cover 22. The amount of compression, being limited to approximately

20 per cent the thickness of the sponge pad 21, provides a resilience or spring action between the cap 17 and the dispensing cover 22. When the cap 17 is fully inserted into the dispensing cover 22, pawls 26 and 27 return to the initial position and grasp the rim 28 or the recessed notches 29 and 30 of the cap 30 thus preventing disengagement of the assembled parts. Recessed notches 29 and 30 of the cap, communicate with the pawls 26 and 27 of the dispensing cover inhibiting rotational movement of the cap 17 to the dispensing cover 22, thereby enabling attachment or removal of the assembled fluid dispensing attachment 13 from the fluid container 10. It is understood that several pawls and recessed notches may be provided. Two only are shown for illustrative purposes. Many types of plastic, commonly used for injection molding purposes, have the resilient properties required in the manufacture of the cap 17 and the dispensing cover 22.

Figure 5:
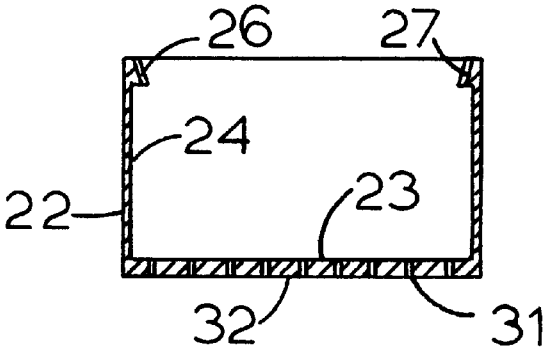
FIG. 5. An exploded view from FIG. 1, section 2—2 showing a cross section of the dispensing cover.

Referring to FIG. 5, multiple small holes or orifices 31 in the face 32 of the dispensing cover 22 determine the area of the tissue 14 to be moistened. The small orifices 31 are of such size as to prevent the escape of fluid 11 from the sponge pad 21, which is saturated with fluid 11 from the fluid container 10, when the hygiene device is in a normal or "ready" position as depicted in FIG. 1. The orifices 31, however, are of sufficient size that fluid 11 is expelled through the orifices 31 when the saturated sponge pad 21 is further compressed by the action of the operator in applying pressure to the dispensing cover face 32 with tissue 14. The amount of fluid 11 dispensed is controlled by the traverse of the dispensing cover 22 relative to the cap 17 and to the extent of compression that is applied to the saturated sponge pad 21.

I claim:

1. A personal hygiene device for the moistening of wiping tissue comprising:

a fluid dispensing device having a bracket dimensioned and configured to hold a container of fluid in an inverted position, said container having a closed end and an open end with a cap attachable and removable from said container, and said cap, having a plurality of holes in the cap face, providing a port for the transfer of fluid from said container through the cap face to a sponge pad, said sponge pad being of resilient foam material and mounted on the cap face; wherein the cap and sponge pad are assembled utilizing a dispensing cover shaped to surround both sponge pad and cap with said dispensing cover sized to communicate with said cap providing a sliding traverse of the dispensing cover relative to said cap, and the face of said dispensing cover, having a plurality of orifices, providing a means of expelling fluid through said orifices when said sponge pad is compressed against said cap by force of tissue applied upon the face of said dispensing cover.

2. The personal hygiene device as recited in claim 1 wherein said bracket holds said container with friction and a fixed stop at the top end of said bracket to prevent upward movement of the container.

3. The personal hygiene device as recited in claim 1 wherein the outer wall of said cap is parallel and perpendicular to the face of said cap.

4. The personal hygiene device as recited in claim 1 wherein the rim of said cap has multiple notches configured for the engagement of pawls on the rim of the dispensing cover.

5. The personal hygiene device as recited in claim 1 wherein the area of the face of the sponge pad is substantially the same as the area of the face of the said cap.

6. The personal hygiene device as recited in claim 1 wherein the inside wall of the dispensing cover is parallel and perpendicular to the face of the dispensing cover.

7. The personal hygiene device as recited in claim 1 wherein the orifices on the face of the dispensing cover are of a small enough size as to inhibit the drainage of fluid from said container but the orifices being of sufficient size as to expel fluid by the depressing of said dispenser cover.

8. The personal hygiene device as recited in claim 1 wherein said dispensing cover limits the compression of said sponge pad and the traverse of the dispensing cover relative to said cap.

9. The personal hygiene device as recited in claim 1 wherein multiple pawls on the rim of said dispenser cover are configured to engage with the notches of the rim of said cap and inhibit rotational movement of said cap to said dispensing cover.

10. The personal hygiene device as recited in claim 1 wherein there is a clearance between the outside wall of the cap and the inside wall of the dispensing cover that is sufficient to provide a sliding traverse of the dispenser cover relative to said cap.

* * * * *